US012622529B2

(12) United States Patent
Lim et al.

(10) Patent No.: US 12,622,529 B2
(45) **Date of Patent: *May 12, 2026**

(54) MATTRESS TOP PANEL AND MATTRESS ASSEMBLIES WITH IMPROVED AIRFLOW

(71) Applicant: Tintoria Piana US, Inc., Cartersville, GA (US)

(72) Inventors: Sang-hoon Lim, Cartersville, GA (US); Andrea Piana, Cartersville, GA (US)

(73) Assignee: Tintoria Piana US, Inc., Cartersville, GA (US)

( * ) Notice: Subject to any disclaimer, the term of this patent is extended or adjusted under 35 U.S.C. 154(b) by 320 days.

This patent is subject to a terminal disclaimer.

(21) Appl. No.: 18/181,748

(22) Filed: Mar. 10, 2023

(65) Prior Publication Data

US 2023/0210271 A1 Jul. 6, 2023

Related U.S. Application Data

(63) Continuation of application No. 17/171,064, filed on Feb. 9, 2021, now Pat. No. 11,627,811, which is a continuation-in-part of application No. 16/367,347, filed on Mar. 28, 2019, now Pat. No. 11,185,171.

(60) Provisional application No. 62/718,602, filed on Aug. 14, 2018, provisional application No. 62/649,943, filed on Mar. 29, 2018.

(51) Int. Cl.
*A47C 27/00* (2006.01)
*A47C 27/05* (2006.01)

(52) U.S. Cl.
CPC ..... *A47C 27/001* (2013.01); *A47C 27/053* (2013.01); *A47C 27/056* (2013.01)

(58) Field of Classification Search
CPC .... A47C 27/001; A47C 27/053; A47C 27/056
USPC ..... 5/690
See application file for complete search history.

(56) References Cited

U.S. PATENT DOCUMENTS 5,819,349 A * 10/1998 Schwartz ..... A47C 27/146 5/722
7,591,049 B2 * 9/2009 Cooper ..... D04H 1/74 19/163
11,185,171 B2 * 11/2021 Lim ..... A47C 27/001
11,627,811 B2 * 4/2023 Lim ..... A47C 27/001 5/721
2004/0062912 A1 * 4/2004 Mason ..... D04H 1/46 442/139
2013/0078373 A1 * 3/2013 Piana ..... B09B 5/00 427/212
2014/0053341 A1 * 2/2014 Parvin ..... B32B 7/12 297/452.48
2015/0096125 A1 * 4/2015 DeFranks ..... D04H 1/4258 112/475.08
2016/0235204 A1 * 8/2016 Andreotti ..... A47C 27/056
(Continued)

*Primary Examiner* — Myles A Throop
(74) *Attorney, Agent, or Firm* — WCF IP

(57) ABSTRACT

Vertically lapped nonwoven material is used without cross lapped nonwoven to provide enhanced breathability and comfort in mattresses by replacing foam material in one or more of, including all of top panel quilts, layers underneath the top panel quilts, and in side blocks which surround spring supports. The vertically lapped nonwoven may provide advantages in terms of cost, manufacturing ease, robustness in mattress design, while at the same time providing the user with a much more comfortable sleeping experience.

5 Claims, 4 Drawing Sheets

(56) References Cited

U.S. PATENT DOCUMENTS

2020/0113345 A1* 4/2020 DeFranks ..... D06M 15/263
2020/0378057 A1* 12/2020 Lim ..... D06M 23/02

* cited by examiner

MATTRESS TOP PANEL AND MATTRESS ASSEMBLIES WITH IMPROVED AIRFLOW

CROSS-REFERENCE TO RELATED APPLICATIONS

This application is a continuation-in-part (CIP) application of U.S. Ser. No. 16/367,347 filed Mar. 28, 2019, which claims priority to U.S. Provisional Application 62/649,943 filed Mar. 29, 2018, and U.S. Provisional Application 62/718,602 filed Aug. 14, 2018, and the complete contents of these applications is incorporated herein by reference.

FILED OF THE INVENTION

The present invention relates to mattress assemblies providing an improved airflow by utilizing vertically lapped nonwovens.

BACKGROUND

Most mattresses sold in the U.S. market contain foam layers to provide comfort to users. But conventional polyurethane foams, latex foams, and memory foams that are used for the mattresses do not provide a good breathability. As the result, many people experience body heat buildup and complain of "sleeping hot".

FIG. 1 shows an example of a conventional one sided mattress. The quilted top panel 11 is constructed of a ticking fabric under which is a layer of fire retardant (FR) fibers (usually in the form of nonwoven), a foam layer (usually polyurethane (PU) foam), and a thin nonwoven fabric (referred to as scrim). This quilted top panel rests on a foam layer 12 (usually PU foam) and a felt pad 13 that fits over spring units 14 and supporting bottom 15. The mattress is referred to as a one-sided mattress because the person using the mattress sleeps only on the side including the quilted top panel.

Two sided mattresses are ones that a person can sleep on either the top or the bottom side because both sides have a quilted top layer and foam layer for the user's comfort. One example configuration of a two sided mattress is a quilted top panel 11, a foam layer 12, a felt pad 13, spring units 14, a felt pad 13, a foam layer 12, and a quilted top panel 11.

Foam mattresses generally differ from conventional mattresses in that the spring support is replaced by different types of foam layers. FIG. 2 shows an example of a foam mattress. In construction, a top layer 21 (usually zippered cover) is positioned over a FR knit layer 22 (referred to as FR sock), and one or more foam layers 23, 24, 25 (one or more of which may be memory foam, latex foam, conventional PU foam, and convoluted foam). Variations can include different combinations of the foams, and spring units can be used instead of bottom support foam. FIG. 9 shows an example of those.

FIG. 3 shows an exemplary mattress which has been cut apart by the inventors. FIG. 3 shows a one sided mattress with a quilted top panel which includes a foam layer therein, underneath the quilted top panel, there are four layers of foam and a felt pad. These are supported by spring members (similar to the configuration shown in FIG. 1).

FIG. 4 illustrates the construction of one example of a quilted top panel for a mattress. In FIG. 4 there is shown a ticking fabric, a FR nonwoven, 2 layers of polyurethane foams, and a scrim, all quilted together.

Korean Application KR 20140073966 to Wi describes a cushion material that purportedly can be used in a variety of applications. The cushion material includes vertically lapped nonwoven with fibers oriented in the vertical direction together with a cross nonwoven fabric oriented in the horizontal direction. Wi explained that the vertically lapped nonwoven is strong against the load in the vertical direction, but the fibers are easily broken in a side to side or oblique direction. Thus, Wi, by proposing a composite material of vertically oriented material and horizontally oriented material, hopes to provide a cushion material that provides better support and resilience properties. However, the solution adds cost for the additional cross-lapped nonwoven containing an elastic binder fiber as well as manufacturing time. Moreover, it adds another layer to the cushion which is less breathable in the crosswise direction.

SUMMARY OF THE INVENTION

One aspect of the invention is to substitute one or more layers of vertically lapped nonwoven material for the one or more layers of foam traditionally used in the quilted top panel for a mattress. The nonwoven, in some embodiments, may be constructed from synthetic or/and natural fibers together with binder fibers, such as the elastic binder polyester fiber, low-melt or high-melt binder fiber, or combinations of these. To increase the density of the nonwoven, high shrink polyester fiber can be added to the blend. The lay up in the invented quilted top panel of a mattress would be a fabric ticking layer, under which is positioned one or more layers of FR barrier, under which is positioned one or more layers of vertically lapped nonwoven, under which is positioned a scrim layer, with the entire lay up being sewn together as a quilted top panel. In most embodiments, the quilted top panel will not include a foam layer; however, depending on the application, the quilted top may optionally also include one or more foam layers under or above the vertically lapped nonwoven layer(s).

Another aspect of the invention is to construct one sided or two sided mattresses with a quilted top panel which includes vertically lapped nonwoven material. The one sided or two sided mattresses may also be constructed with one or more foam layers underneath the quilted top panel being replaced with one or more layers of vertically lapped nonwoven material. In some embodiments, the mattresses will have the foam layers completely or substantially eliminated. That is, the quilted top will include vertically lapped nonwoven and the underlying layers which fit over the spring support will also be vertically lapped nonwoven (or at least some of the underlying foam layers will be replaced by vertically lapped nonwoven). In some embodiments, the multi-layers of foam underneath the quilted top panel can be used without being replaced with vertically lapped nonwoven.

Yet another aspect of the invention is to construct a foam mattress which includes one or more layers of vertically lapped nonwoven over the foam (instead of PU foams, memory foams, or latex foams, etc.). That is, foam mattresses will have a cover fabric on top, an underlying FR barrier (usually referred to as FR socks), an underlying assembly of one or more vertically lapped nonwoven layers, and the foam layers. The vertically lapped nonwoven will replace foam layers partially or completely depending on required performance.

In the top layer and mattress, there is no cross-lapped nonwoven containing an elastic binder fiber. This avoids obstructions to cross-wise breathability and the "sleeping hot" problem attributable thereto.

DETAILED DESCRIPTION

Figure 5:
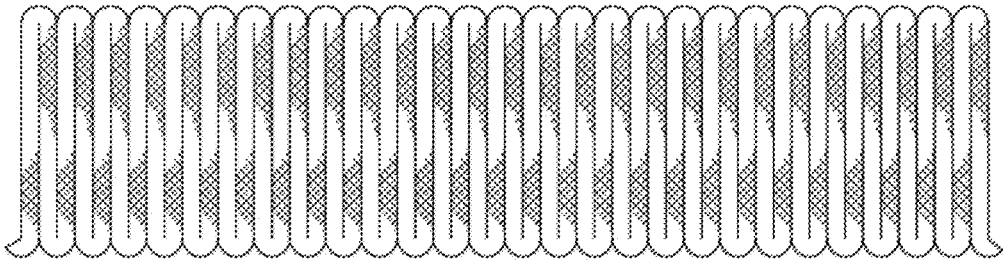
FIG. 5 shows a side view of a vertically lapped nonwoven.

The vertically lapped nonwoven material can be produced by commercially available machines, such as V-Lap vertical lapping systems sold by V-Lap Pty Ltd. and by Struto International, Inc. In the V-Lap system, staple fiber blend including binder fibers are opened, blended, and carded. The carded fiber web is pleated and the fibers are bonded mechanically (needling) and thermally to produce vertically lapped nonwovens. In the Struto system, the carded fiber web containing binder fiber is fed into the Struto lapping device. The vertical lapper then folds the web into a uniform structure. The folds are compressed together into a continuous structure, which is held in vertical position as it passes the heated thermal bonding oven. FIG. 5 shows the side view of an exemplary vertically lapped nonwoven and it shows that a majority of the fibers (e.g., 60%, 70%, or 80% or more) are oriented vertically in the nonwoven material.

Due to its vertical fiber arrangement, the vertically lapped nonwovens provide better resilience and shape recovery to compression compared to cross-lapped nonwovens. Especially when the vertically lapped nonwoven is made with elastic binder fibers and high resilience fibers, it provides a very good resilience. As examples of elastic polyester binder fibers, ELK®, E-PLEX®, and EMF type high elastic LMF are commercially available from Teijin Limited, Toray Chemical Korea Inc., and Huvis Corporation, respectively. The elastic polyester binder fiber provides an elastic property to the nonwoven and provides bonding between fibers after the thermal bonding process. To provide bulkiness and resilience to the nonwoven, hollow conjugate polyester fiber can be used together with binder fibers, such as the elastic binder polyester fiber, conventional binder fibers, or combination of these. To increase the density of the nonwoven, high shrink polyester fiber can be added to the blend. In addition to these fibers, other fibers can be used to give other required functions. Exemplary types of polyesters which may be used in the practice of the invention include, but are not limited to PET (polyethylene terephthalate), PTT (polytrimethylene terephthalate), and PBT (polybuthylene terephthalate). The most commonly used polyester is PET.

Examples of fiber blends for the vertically lapped nonwovens which can be advantageously used in the quilted top panel of one sided or two sided mattresses, and/or under the quilted top panel of one sided or two sided mattresses, or which can be used under the FR sock in a foam mattress include but are not limited to the following:

- Elastic polyester binder fiber (6 denier×64 mm): High shrink polyester fiber (1.4 denier×51 mm): Low-melt polyester binder fiber (4 denier×51 mm):Regular polyester fiber (6 denier×51 mm)=25:20:10:45
- Hollow conjugate polyester fiber (3 denier×51 mm): Elastic polyester binder fiber (6 denier×64 mm)=60:40
- Hollow conjugate polyester fiber (15 denier×51 mm): Elastic polyester binder fiber (6 denier×51 mm)=60:40
- Hollow conjugate polyester fiber (15 denier×51 mm): Low-melt polyester binder fiber (4 denier×51 mm)=70:30
- Hollow conjugate polyester fiber (3 denier×51 mm):High shrink polyester fiber (1.4 denier×51 mm):Elastic polyester binder fiber (6 denier×64 mm):Low-melt polyester binder fiber (4 denier×51 mm)=40:20:30:10
- Hollow conjugate polyester fiber (3 denier×51 mm):High shrink polyester fiber (1.4 denier×51 mm):Elastic polyester binder fiber (6 denier×64 mm)=50:10:40
- Hollow conjugate polyester fiber (3 denier×51 mm): Hollow conjugate polyester fiber (15 denier×51 mm): Elastic polyester binder fiber (6 denier×64 mm):Low-melt polyester binder fiber (4 denier×51 mm)=50:25:15:10

The vertically lapped nonwoven may be made from man-made and/or natural fibers together with binder fibers, such as the elastic binder polyester fiber, low-melt or high-melt binder fiber, or combinations of these. The nonwoven will preferably include at least 35-90% polyester fiber (e.g., hollow conjugate polyester, regular polyester fiber, high shrink polyester fiber, conventional polyester binder fiber, or combination of these). The nonwoven will preferably contain 5-50% elastic polyester binder fiber. Additional man-made (e.g., rayon, lyocell, Nylon, Kevlar, etc.) and/or natural fibers (e.g., cotton, jute, silk, wool, linen, cashmere, etc.) may also be included.

As shown in FIG. 5, the vertically lapped nonwovens include a significant amount of fibers that are in a vertical direction, so they can provide a good firmness and resilience that are comparable to those of the foams used in quilted mattress top panels or underneath the quilted top panel as well as they provide better breathability compared to foams.

Figure 1:
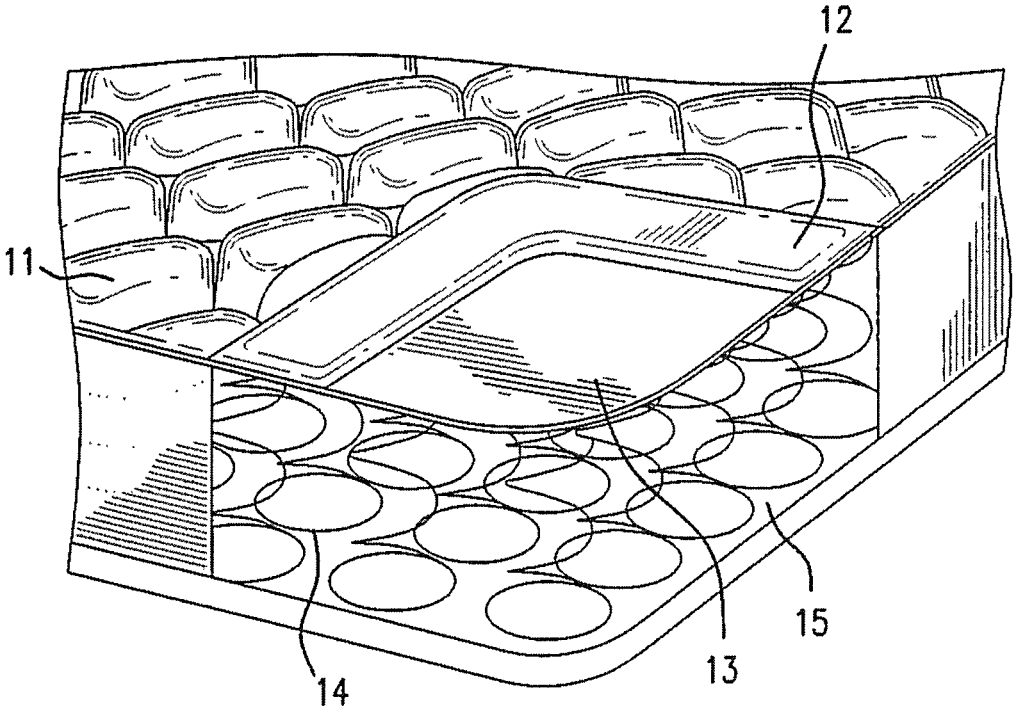
FIG. 1 is a cutaway view of a conventional one sided innerspring mattress.
Figure 2:
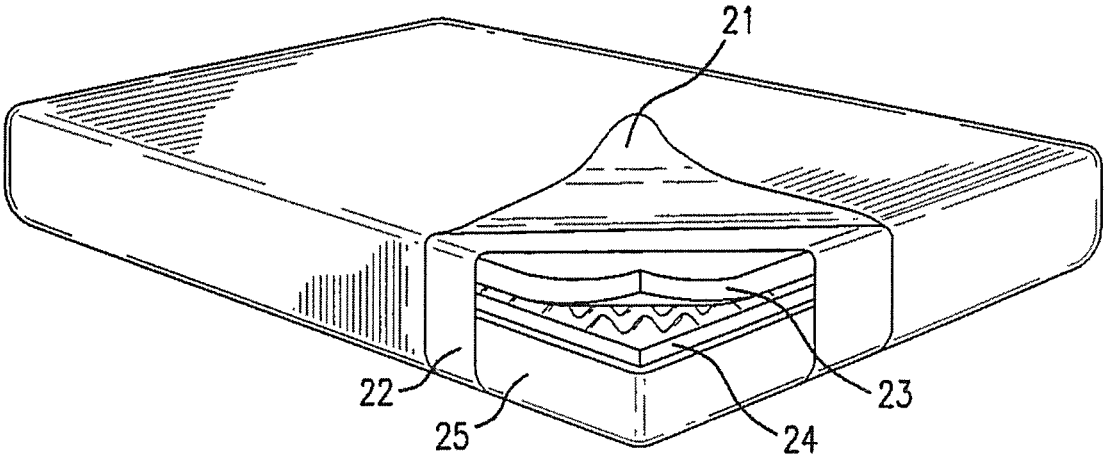
FIG. 2 is a cutaway isometric view of a foam mattress.
Figure 6:
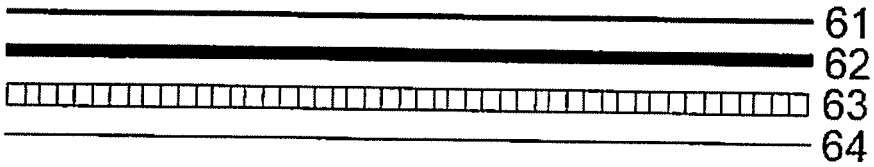
FIG. 6 shows an exemplary lay up of a quilted top for a one or two sided mattress according to an embodiment of the invention.

FIG. 6 shows the multilayer structure for the top quilted panel according to the invention. The lay up would generally be a top layer or ticking fabric 61, under which is placed an FR layer 62 (e.g., a FR nonwoven). Under the FR layer will be one or more layers of vertically lapped nonwoven 63 (such as, for example, the blends set forth above). The bottom layer 64 will be scrim or other suitable material. In addition to the basic assembly of a top panel, an FR material and one or more layers of vertically lapped nonwoven, additional layers of materials may also be included depending on the application and design choice of the manufacturer. For example, while not depicted in FIG. 6, in some applications, PU foam, latex foam or other materials might be included under or above the one or more layers of vertically lapped nonwoven. The entire lay up would be sewn together as a quilted top panel or a top layer (e.g., stitching passing through all layers from top to bottom). This quilted top panel or the top layer can then be used on any of a variety of mattresses and mattress assemblies (e.g., one sided or two sided). The quilted top panel or the top layer with the vertically lapped nonwoven can take a variety of forms. For example, it may be built into the top of a one sided or two sided mattress as shown in FIG. 1. Alternatively, it may be positioned under a zippered cover or a FR sock or form or be part of the zippered cover which fits over a mattress, such as a foam mattress as shown in FIG. 2. See also FIGS. 6 and 8 for alternative top layer embodiments.

Figure 7:
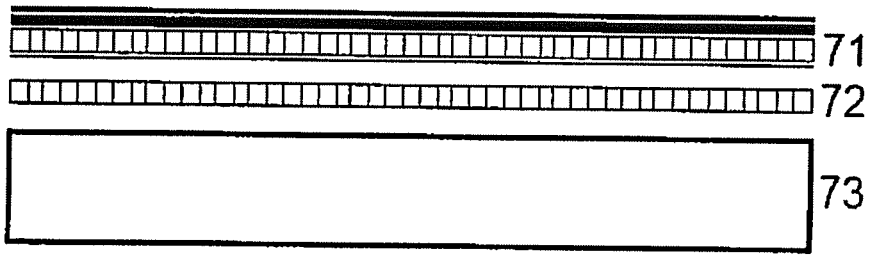
FIG. 7 shows an exemplary lay up of a one sided mattress according to an embodiment of the invention.

FIG. 7 shows a particular embodiment of the invention where the multilayered quilted top panel or top layer depicted in FIG. 6 is used on a one sided mattress assembly. In FIG. 7, in addition to having the vertically lapped nonwoven material in the quilted top panel or the top layer (see, e.g., 71 together with other layers as discussed in conjunction FIG. 6), the configuration includes an additional one or more layers of vertically lapped nonwoven material 72 underneath the quilted top panel or the top layer, between the quilted top panel or the top layer and foams layers/spring assembly 73. That is, one embodiment of the invention includes an invented quilted top panel or the top layer as discussed in connection with FIG. 6 over top of a mattress assembly, either integrated therewith or forming part of a zippered cover or sock which covers the mattress, which includes one or more layers of vertically lapped nonwoven between the quilted top panel and the foam layers/spring assembly. Embodiments of the invention also include having one or more vertically lapped nonwoven material 72 under a conventional quilted top panel or the top layer. Other embodiments of the invention include having the vertically lapped nonwoven material in layer 71 or 72 present together with one or more foam layers (e.g., PU foam, etc.) respectively in the quilted top panel or under the quilted top panel. The one or more vertically lapped nonwoven layers can be placed on, between, or under foam layers. Another embodiment of the invention includes replacing all foam layers in the mattress with vertically lapped nonwoven layers. If needed, at least some of foam layers, or some of the vertically lapped nonwoven layers, or at least one foam layer and one vertically lapped nonwoven layer are bonded together. Depending on different mattress design choices the top layer 71 may not contain any vertically lapped nonwoven.

In some embodiments, to promote breathability and to prevent sleeping hot, the top layer 71 could contain a vertically lapped nonwoven, and the layer 72 directly under the top layer could contain vertically lapped nonwoven. However, it is also possible to have the top layer not contain vertically lapped nonwoven, but the layer directly underneath the top layer (e.g., 72) include vertically lapped nonwoven. As yet another embodiment, only the top layer 71 could contain vertically lapped nonwoven, and the layer under the top layer would not include vertically lapped nonwoven. The objective in each of these embodiments would be to have the vertically lapped nonwoven relatively closer to the persons body to provide both support and breathability.

Some mattresses can include mini springs between foam layers. This invention contemplates replacing any foam layer in any mattress with a vertically lapped nonwoven layer. Thus, in some mattresses mini springs can be positioned between vertically lapped nonwoven layers; in some mattresses, vertically lapped nonwoven layers may be under or within a zippered cover which covers the mattress; in some mattresses vertically lapped nonwoven layer may be positioned below a top layer on either or both the top or bottom surface of a mattress; and in some mattresses, vertically lapped nonwoven may be positioned adjacent to and encircling all or part of the spring support or foam block. Any combination of the above is also contemplated.

Figure 8:
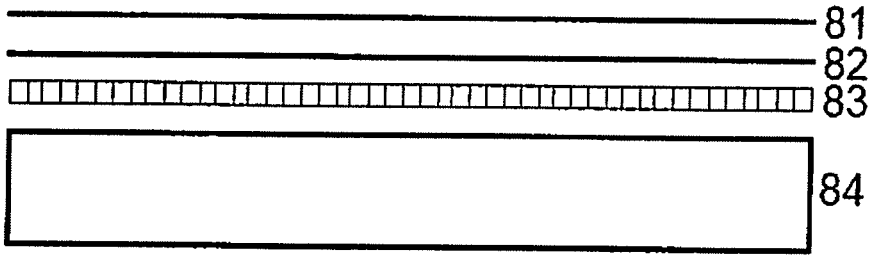
FIG. 8 shows an exemplary lay up of a foam mattress according to an embodiment of the invention.

FIG. 8 shows an exemplary lay up which may be employed with foam mattress assemblies. In particular, under a top cover fabric layer 81 will be an FR layer 82 followed by one or more layers of vertically lapped nonwoven material 83 all positioned over one or more foam layers 84. The vertically lapped nonwoven will provide a degree of "breathability" to the person sleeping on the mattress. That is, prior art foam mattresses have been viewed as "hot" and uncomfortable, particularly in warm environments, due to the foams not being able to pass air therethrough and/or shed the heat provided by the person's body. Depending on the product design, the vertically lapped nonwoven can be placed on top of foam or/and between foam layers. In an embodiment of the invention, all foam layers in the mattress can be replaced with vertically lapped nonwoven layers. If needed, the layers may be bonded together.

In the top layer and mattress, there is no cross-lapped nonwoven containing an elastic binder fiber. This avoids obstructions to cross-wise breathability and the "sleeping hot" problem attributable thereto.

Figure 9:
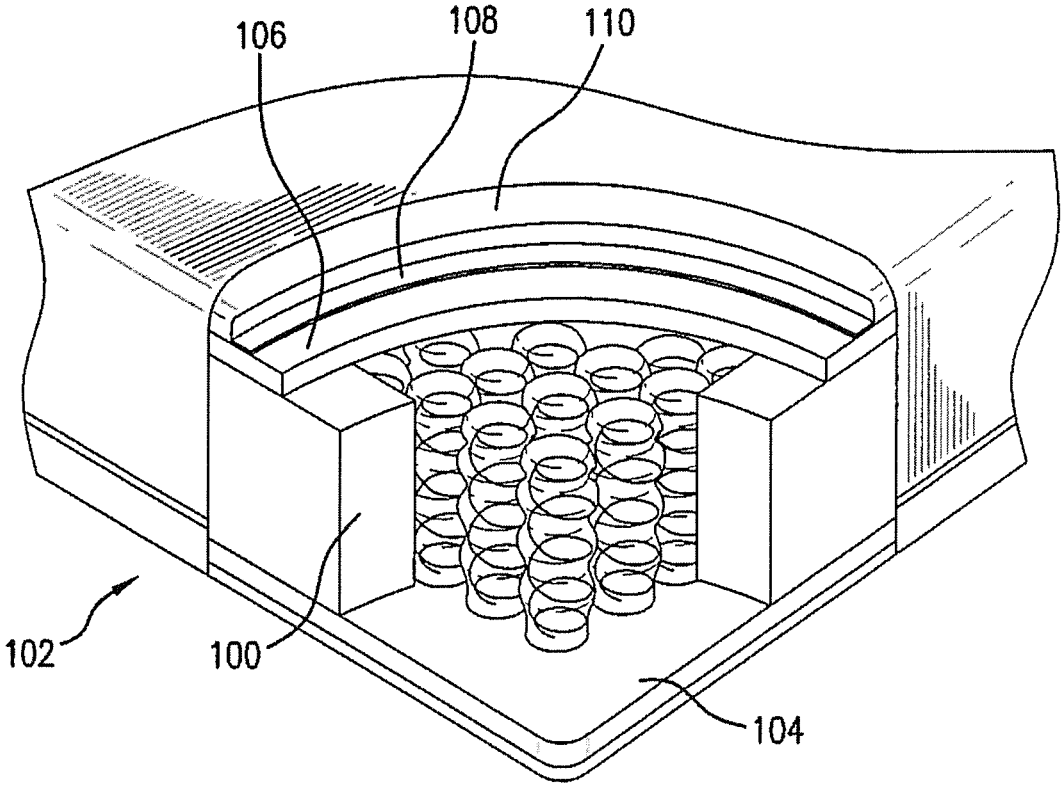
FIG. 9 shows an exemplary mattress design with foam material surrounding the springs positioned between the top and bottom of the mattress, and an embodiment contemplates replacing the surrounding foam material with blocks made with vertically lapped nonwovens, and, in some embodiments, the foam layers in the mattress can be replaced with the vertically lapped nonwovens partially or fully.

FIG. 9 shows a mattress design with a foam block member 100 encircling the springs at the sides of the mattress 102 positioned between the top and bottom of the mattress. In an embodiment of the invention, this foam block member 100 is replaced with a block made from vertically lapped nonwovens. One of the advantages would be that the block made from vertically lapped nonwovens would allow better air flow into and out of the spring region of the mattress, and thereby allow for mattress that is "cooler" for the person using the mattress. To make this block of vertically lapped nonwovens, several layers of vertically lapped nonwovens are put together (adhesive-bonded or heat-bonded) to achieve a desired thickness of the block and then blocks are then cut from the assembled and joined layers of vertically lapped nonwovens. In addition to the use of blocks 100 made from vertically lapped nonwoven, one or all of the foam layers 104, 106, 108, 110 above and under the springs can be replaced with vertically lapped nonwoven layers. If needed, the layers may be bonded together.

The vertically lapped nonwoven for this invention may be formed to have a thickness and density selected according to the physical and air permeability properties desired by mattress manufacturers. For the vertically lapped nonwoven to be used in the mattresses, the specification of the nonwoven preferably will be as below:

The nonwoven basis weight is 50-2000 g/m$^2$, preferably 150-600 g/m$^2$.

The loft of nonwoven is 5-150 mm, preferably 12-50 mm.

As discussed above, aspects of the invention pertain to mattress assemblies that utilize vertically lapped nonwovens underneath fire barrier layers of the sleeping surface to provide an improved airflow to the users.

Figure 3:
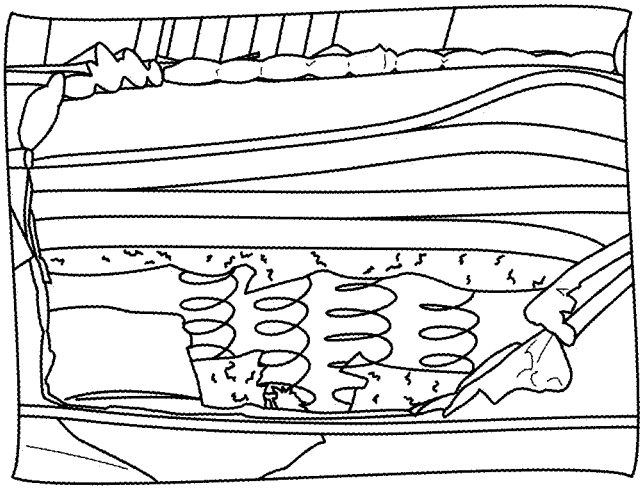
FIG. 3 is a drawing of a mattress showing the quilted top panel over multiple foam layers and a set of springs.
Figure 4:
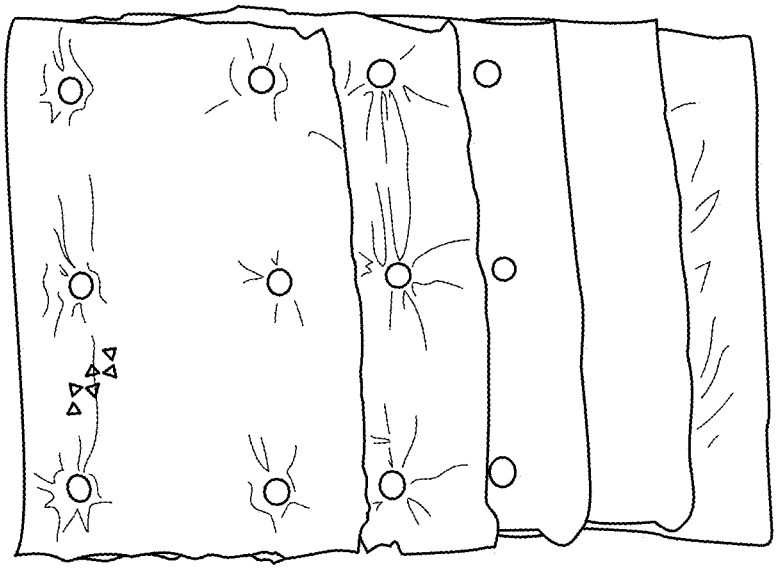
FIG. 4 is a drawing showing an example of multiple layers used in a quilted top panel for a mattress.

As discussed above in conjunction with FIGS. 1 and 3, an example assembly of a sleeping surface of conventional inner spring mattresses, from the top, comprises of ticking fabric, fire barrier nonwoven fabric, one or more layers of polyurethane foam, thin scrim fabric and these are quilted together (called a quilted top panel). Underneath this quilted top panel, there are multi-layers of foam, springs, and bottom support. In contrast, in various embodiments of this invention such as described in conjunction with FIG. 6, the one or more layers of foam in the quilted top panel are replaced with the vertically lapped nonwovens partially or fully to provide an improved airflow to the users. The multi-layers of foam underneath the quilted top panel can be used without being replaced with vertically lapped nonwovens or, as is best shown in FIG. 7, can be replaced with vertically lapped nonwovens partially or fully. An example assembly of a sleeping surface of conventional foam mattresses includes, from the top, a cover fabric, fire barrier knit fabric, and one or more layers of foam. In contrast, as best depicted in FIG. 8, aspects of this invention include one or more vertically lapped nonwovens being placed on top of the foams to provide an improved airflow to the users. Depending on the mattress design, one or more vertically lapped nonwovens can be used together with one or more foam layers or the foam layers can be completely replaced with vertically lapped nonwoven layers.

The invention claimed is:

1. A mattress, comprising:

a top layer comprising a fabric layer, one or more fire retardant layers, and a bottom layer, wherein said fabric layer, said one or more fire retardant layers, and said bottom layer are assembled together with stitching passing through each of the fabric layer, the one or more fire retardant layers, and the bottom layer from a top to a bottom of the top layer;

one or more layers of foam material;

one or more layers of vertically lapped nonwoven material positioned under the top layer; and a spring or foam support, wherein the one or more layers of foam material are positioned above the one or more layers of vertically lapped nonwoven material, and wherein the one or more layers of vertically lapped nonwoven material are positioned above the spring or foam support.

2. The mattress of claim 1, wherein the top layer comprises one or more additional layers of vertically lapped nonwoven material which is assembled together with said fabric layer, said one or more fire retardant layers, and said bottom layer with said stitching passing through the one or more additional layers of vertically lapped nonwoven material.

3. The mattress of claim 2 wherein either or both said one or more additional layers of vertically lapped nonwoven material in said top layer, and said one or more layers of vertically lapped nonwoven material under said one or more layers of foam material and above said spring or foam support comprise one or more synthetic or natural fibers.

4. The mattress of claim 1 wherein the top layer does not include polyurethane material.

5. The mattress of claim 1 wherein said one or more layers of vertically lapped nonwoven under said top layer comprise one or more synthetic or natural fibers.

* * * * *